United States Patent [19]

Grange et al.

[11] 4,047,979

[45] Sept. 13, 1977

[54] HEAT TREATMENT FOR IMPROVING THE TOUGHNESS OF HIGH MANGANESE STEELS

[75] Inventors: Raymond A. Grange, Roseburg, Oreg.; Robert L. Miller, Hempfield Township, Westmoreland County, Pa.

[73] Assignee: United States Steel Corporation, Pittsburgh, Pa.

[21] Appl. No.: 730,894

[22] Filed: Oct. 8, 1976

[51] Int. Cl.[2] ..... C21D 7/14; C22C 38/04

[52] U.S. Cl. ..... 148/12 R; 148/12 F; 148/12.4; 148/36

[58] Field of Search ..... 148/12 R, 12 F, 12.4, 148/36

[56] References Cited

U.S. PATENT DOCUMENTS

| | | | |
|---|---|---|---|
| 2,516,125 | 7/1950 | Kramer et al. | 148/36 |
| 3,235,413 | 2/1966 | Grange et al. | 148/12.4 |
| 3,250,648 | 5/1966 | Grange et al. | 148/12.4 |
| 3,423,252 | 1/1969 | Grange | 148/12.4 |

*Primary Examiner*—W. Stallard

*Attorney, Agent, or Firm*—Arthur J. Greif

[57] ABSTRACT

The potent hardenability effect of manganese and its relatively low cost and availability make it an attractive candidate for the production of high strength steels, especially in the range of about 2.0 to 6.0 percent manganese. The main deterent to the use of such high manganese steels has been their poor toughness. This can be improved by producing steels with high purity or with controlled low carbon contents. However, the requirements of high purity and very low carbon tend to offset, to a large extent, the cost advantage of manganese. The instant invention utilizes an intercritical anneal at a temperature just slightly above austenite start temperature ($A_s$) in order to form retained austenite at the grain boundaries. The steel is heated at temperatures from the $A_s$ to about $A_s + 75°$ C for time periods varying from as little as one minute to 16 hours, the time being generally inversely proportional to the temperature. While this annealing procedure will produce enhanced toughness for high purity steels containing controlled low carbon contents, it will also provide steels containing a combination of high strength (greater than 90 ksi) with a CVN energy absorption value at minus 50° F of greater than 30 ft./lbs. even for steels containing normal impurity levels and conventional carbon contents.

11 Claims, 4 Drawing Figures

HEAT TREATMENT FOR IMPROVING THE TOUGHNESS OF HIGH MANGANESE STEELS

Figure 1A:
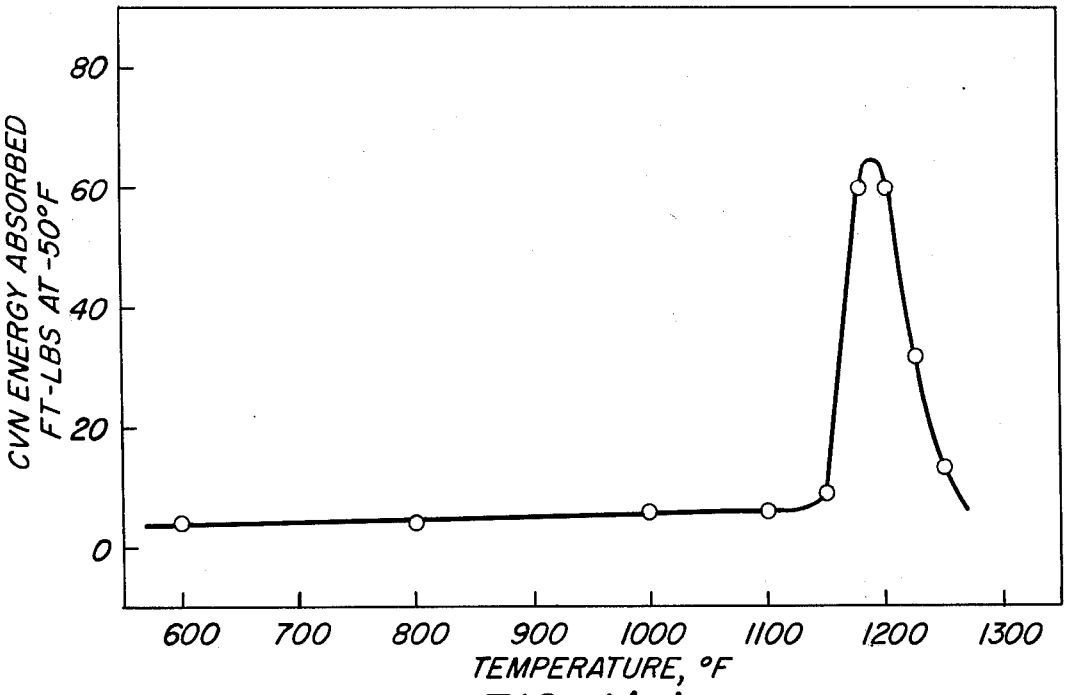

Small amounts of manganese are found in nearly all steels, because of its historical role in reacting with sulfur to form MnS and thereby prevent hot shortness. Larger amounts of manganese are present in constructional steels because of its beneficial effect on notch toughness. The improvement in notch toughness results because, in amounts up to about 1.75 percent, manganese acts to refine the ferrite grain size and prevent the formation of brittle intergranular films of carbide. Because of the potent hardenability effect of manganese, it has also been utilized in a number of quenched and tempered steels. However, interest is increasing in the use of much higher amounts of manganese than normally present in steel. Low-carbon steels containing 2.0 to 4.0 percent manganese are air hardening in thicknesses up to 6 inches and such high-manganese steels offer an attractive possibility for developing hot-rolled plate steels with yield strengths of the order of 100 ksi. The major drawback to high-manganese steels has been their poor toughness.

One of the first attempts to utilize more manganese in steel was the replacement of part of the nickel in existing high-nickel steels. This approach was taken first in maraging steels with 12–18% Ni, and later in cryogenic steels with 5–9% Ni. However, in both cases, toughness was greatly impaired when manganese exceeded about 2.0 percent. A possible explanation for the poor toughness is the occurrence of an embrittling NiMn precipitation reaction. This precipitation reaction, involving formation of NiMn, limits the amount of manganese that can be added to replace nickel in high-alloy steels that require tempering or aging.

Impurity elements, such as phosphorus, are known to interact strongly with manganese and thereby increase the tendency toward temper embrittlement. The toughness of high-manganese steels may therefore be improved by lowering the concentration of phosphorus and other impurity elements. This approach is costly and has not been utilized to date. Another approach for improving the toughness of high-manganese steels is to lower the carbon content. This possibility has received the greatest amount of development work and has resulted (U.S. Pat. No. 3,518,080) in a high-strength, weldable, constructional steel containing 2.0 to 6.0 percent manganese and 0.04 percent maximum carbon.

It was the proper balancing of carbon and manganese that led to the development, in Sweden, of commerical manganese steels with 2.5, 3.5 and 4.5 percent manganese. Commonly known as FAMA steels, they are used in the martensitic condition, either as-rolled or quenched. It was found that impact properties deteriorate in these steels when carbon is greater than 0.04 percent. Of this amount, it is estimated that 0.01 percent is bound with a strong carbide former that is generally added to the steel and 0.02 to 0.03 percent is segregated to dislocations in the martensite cell walls. However, the carbon content cannot be too low. For example, in the 3.5 percent manganese steel, if carbon is less than 0.015 pecent, no martensite forms at practical cooling rates. Since martensite is the desired transformation product in these steels, the carbon content must be closely controlled at approximately 0.03 percent. However, to achieve high manganese contents together with such low-carbon contents requires the use of low-carbon ferro-manganese or electrolytic manganese, both being about twice as costly as high-carbon ferromanganese. As a result, these very low carbon high-manganese steels are economically less attractive.

It is therefore a principle object of this invention to provide a method for enhancing the toughness of high manganese steels.

It is yet another object of the instant invention to provide a method for achieving a combination of high yield strength and good toughness which does not require close control of the carbon content.

These and other objects of the instant invention will become more apparent from the reading of the following description when taken in conjunction with the appended claims and the drawing in which, FIGS. 1*a* and *b* show the effect of tempering temperature on (a) the percentage of retained austenite at the grain boundaries and (b) toughness of a 4% manganese steel.

Figure 2:
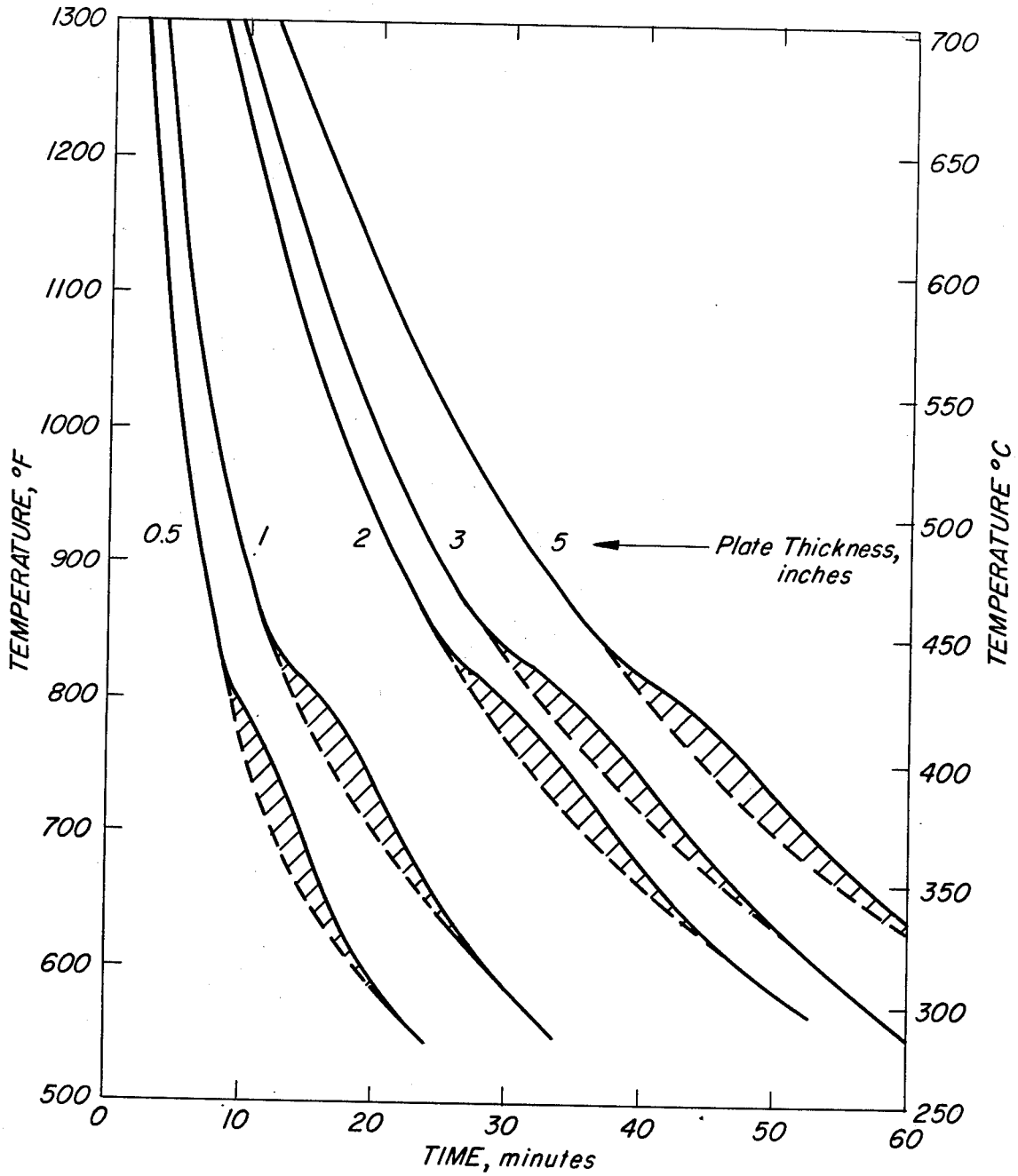

FIG. 2 presents the cooling curves at the center of air-cooled plates of various (simulated) thicknesses, showing transformation (recalescence) between 850° and 600° F (454° and 316° C).

Figure 3:
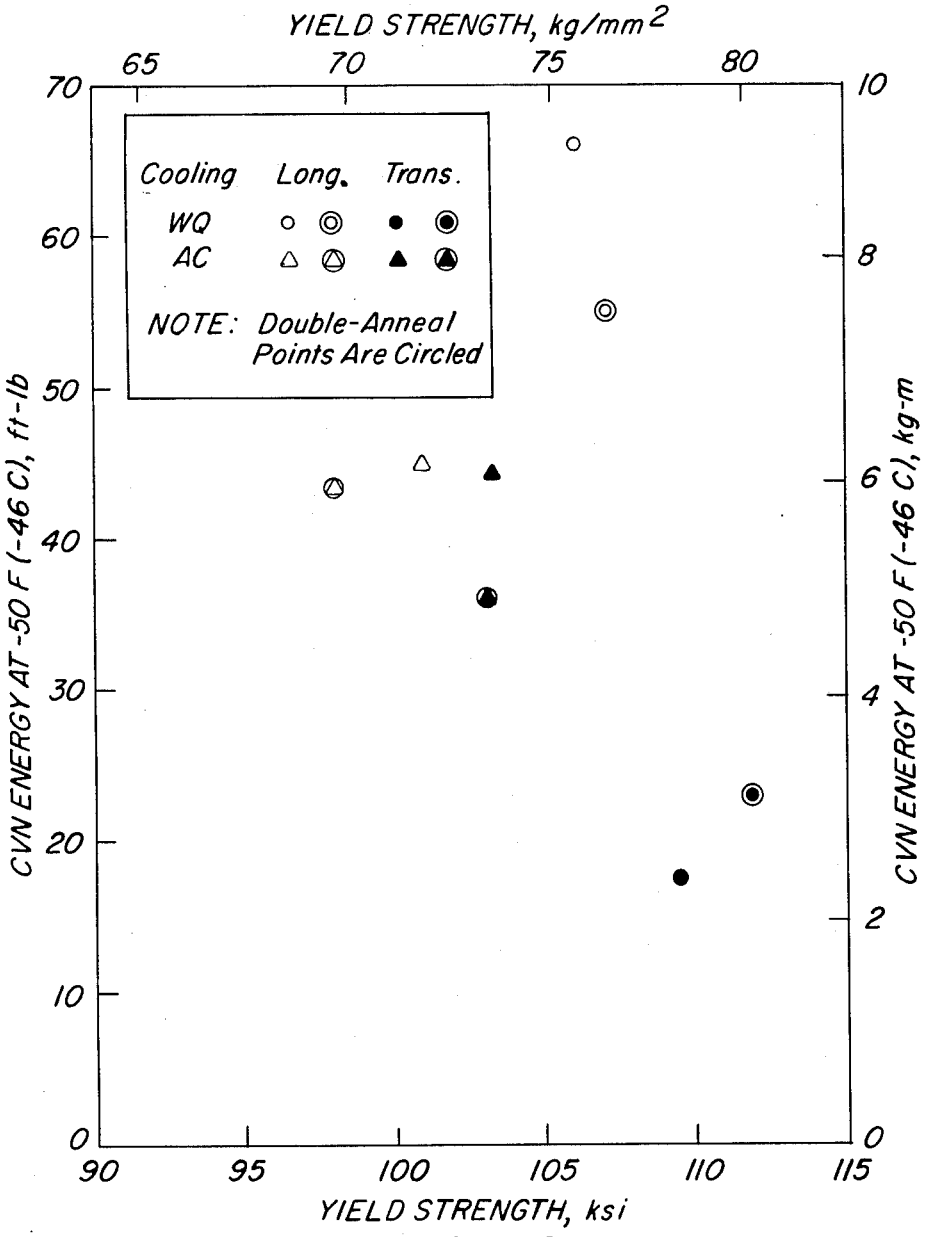

FIG. 3 compares the effect of air-cooling vs. water quenching on the yield-strength and CVN impact properties.

Initial work leading to the instant invention began with the study of high manganese steel containing graded amounts of carbon in the range of 0.002 to 0.20 percent. Mechanical testing of these specimens showed that tensile properties were very encouraging, but that notch toughness was very poor, especially at the higher end of the carbon range. However, it was discovered that toughness was improved in all the steels by tempering at relatively high temperatures. It was found that these latter steels were inadvertently tempered above the $A_s$ and that the improvement in toughness was due to the presence of austenite that formed during tempering and which was retained on cooling to room temperature. This concept of selecting a heat treatment to deliberately form a small amount of stable austenite was therefore applied in the development of the instant invention.

It should be borne in mind that retained austenite which forms during an intecritical heat treatment differs from the normal austenite that is sometimes found in hardened steel. In the latter case, austenite retained after cooling from a temperature above the $A_3$, i.e. where the steel was fully austenitic, has essentially the same composition as the transformation product that forms during cooling. Because it is unstable this austenite can adversely affect the mechanical properties. Conversely, austenite that forms when the steel is heated or worked at temperatures between the $A_1$ and the $A_3$ is usually enriched in alloying elements and therefore more resistant to transformation. This enrichment phenomenon is more fully explained in U.S. Pat. No. 3,755,004, the disclosure of which is incorporated herein by reference. Although is has been determined that it is the formation of this intercritically formed, enriched austenite which is critical to improving the toughness of high manganese steels, the exact role that this intercritical austenite plays has not yet been established. One possible explanation for its effectiveness is indicated in U.S. Pat. No. 3,755,004 wherein it is shown that this enriched austenite forms in prior austenite grain boundaries and in martensite or bainite plate interfaces and probably acts as sinks for impurity elements and for excess carbon. Thus, in effect, the carbon content of the ferritic matrix is substantially lowered and a toughening effect can result. For maximum toughening, enough austenite must be formed to dissolve a substantial amount of the carbides; the austenite becomes high in carbon and since it contains a high amount of manganese as well, it is retained on cooling to room temperature. However, if the annealing temperature is too high within the intercritical range then too much austenite if formed, with the result that its average carbon content is lowered to the extent where some of it will transform to martensite on cooling. When this occurs, both toughness and yield strength are lowered. Another possible explanation is that ductile austenite particles absorb energy as a crack propagates, either by plastic deformation or by transformation as in TRIP steels. Since austenite that forms at intercritical temperatures is enriched in alloying elements, the degree of enrichment and therefore its resistance to transformation, can be varied by changing the annealing temperature. By adjusting the stability of the austenite so that it transforms during straining, a high degree of work hardening may be obtained.

Figure 1B:
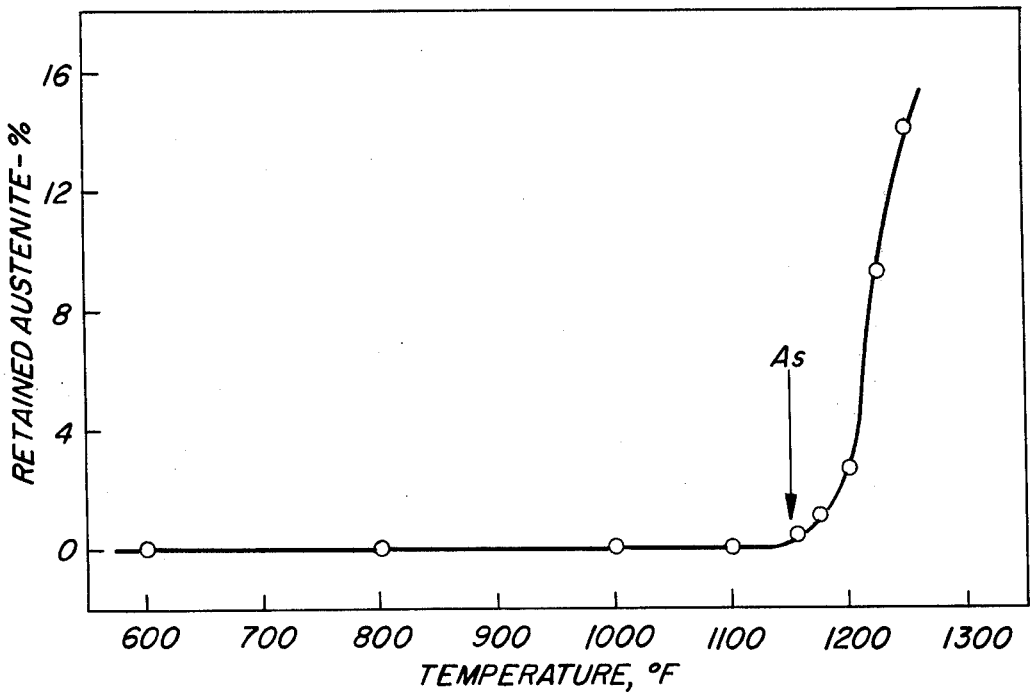

The criticality of developing the proper amount of austenite (i.e. proper balancing of annealing time and temperature) is shown drammatically in FIG. 1. A nominal 4% manganese steel, of commercial plurity, was austenitized at 1450° F (790° C), and thereafter quenched; Charpy V-Notched specimen blanks were reheated to temperatures in the range 600° to 1300° F (315° to 704° C), held for one hour and quenched. Full size CVN specimens machined from the blanks were tested at −20° F (−45.5° C) with the results shown in FIG. 1. As expected, the 4% manganese steel displays extremely poor toughness (4 to 6 ft/lbs) after tempering at all temperatures up to 1150° F (620° C). However, the toughness abruptly increases to 60 ft/lbs at temperatures slightly above the $A_s$, the temperature at which austenite begins to form in the microstructure. In carbon-manganese steels that do not contain any additional alloy elements the narrowness of the temperature range in which improved toughness is observed offers an explanation as to how this phenomena may have been overlooked in the past.

It should be understood, however, that the temperature range for achieving such enhanced toughness cannot be delineated with a great degree of specificity. For any given steel, the temperature range will, of course, vary depending upon the heating time. Thus, the use of longer times will have the effect of shifting the curve to the left and conversely, shorter times will shift the curve to the right. Both the apex and the shape of the curve will also be effected by the prior treatment of the steel, e.g. the degree of segregation and the amount of austenite already present in the steel prior to intercritial annealing. Thus, the amount of austenite retained in the steel after a particular intecritical anneal will be dependent on at least three major criteria: (i) some of the austenite that forms will result from the growth of the austenite particles aready present in the material on cooling from above the $A_3$ temperature, (ii) some austenite will also form preferentially in the segregated (banded areas) areas that are almost inevitably present in high alloy steels and (iii) austenite which forms at grain boundaries or in other austenite which forms at grain boundaries and other high energy interfaces. It is this latter austenite which is "effective" in improving notch toughness. In the work reported in FIG. 1, special care was taken to minimize segregation effects and to insure than no austenite was already present in the steel prior to intercritical annealing. Thus, the amount of austenite reported is substantially only that present at grain boundaries. It may be seen, however, if austenite particles had already been present in the steel, that the amounts reported would have been significantly greater than that shown in FIG. 1. Such excess austenite, although retained on cooling, would provide only a comparatively minor enhancement of notch toughness.

Compositional limitations will, of course, also exert a significant effect on the optimum temperature range and heat treatment times. Thus, the amount of austenite stabilizing elements, here principally manganese and carbon, but also some nickel or nitrogen will affect the temperature range. Additional alloying elements, although not required for hardenability, will yield improved response to the intercritical anneal. Thus, the addition of 0.1 percent vanadium was found to inhibit softening and reduce somewhat the sensitivity of the steel to small variations in annealing temperature, i.e. to provide greater latitude in the time and temperatures required for achieving optimum annealing. However, the addition of this degree of vanadium had a concommitant adverse affect in increasing the requisite annealing time. By lowering vanadium to 0.05 percent and adding 0.25 percent molybdenum, the critical temperature range for achieving optimum annealing was somewhat expanded, without encountering the concommitant adverse affect of increasing the requisite annealing time.

Effect of Plate Thickness — All the steels used in the investigation were initially rolled to 1-inch plate, hence thicker plate was not available. However, one-inch plates were stacked during heat treating to simulate thickness of 3 and 5 inches. A 2-inch-thick plate was simulated by stacking a one-inch-plate between two 0.5-inch plates. In this way, plate thicknesses of 0.5, 1, 2, 3 and 5 inches were simulated. A thermocouple in a hole drilled near the center of each size of plate was used for measuring temperature. All plates (of a nominal 4% Mn steel) were austenitized at 1700° F (926° C), removed from the austenitizing furnace and air cooled. FIG. 2 shows the cooling curves for each of the above five plate thicknesses. The temperature range of transformation is revealed in these cooling curves by departure from a smooth curve (recalescence), indicated by the cross-hatched areas. Transformation occured in all thicknesses mostly in the bainite region (below 850° F). The remarkable feature of the cooling transformation in these plates, is the absence of any significant effect of cooling rate (plate thickness) of the transformation temperature. This is a highly desirable characteristic of high manganese steels because it indicates that mechanical properties are not likely to deteriorate markedly as plates become thicker.

To further evaluate this highly desirable characteristic, i.e. lack of sensitivity to cooling rate, plates of a nominal 4% Mn steel were either water quenched or air cooled after hot rolling. Duplicate plate samples were prepared, one was single annealed for 8 hours to 1150° F (620° C); while the other was double annealed by heating for 4 hours at 1150° F, cooling to room temperature and then reheating for an additional 4 hours at 1150° F. The double anneal was evaluated here because of an indication, in one experiment, that a double anneal could further improve toughness. Tension specimens 0.25 inches in diameter in the gage length and standard size Charph V-Notch (CVN) impact specimens were taken from each of the four plates in both longitudinal and transverse directions. The results are shown graphically in FIG. 3. The mechanical properties of both the water quenched and air-cooled plate were, on the average, about equally good, their yield strengths were well above 90 ksi with CVN impact energies mostly above 30 ft/lbs, (at −50° F). It is also clear, that double annealing had no advantage over single annealing. An unusual feature of the above data is that the water quenched plates are highly anistropic (lower toughness in the transverse direction), whereas the air-cooled plates are not. Metallographic examination of these steels revealed elongated sulfide inclusions as well as severe banding. This combination of elongated inclusions and severe banding evidently explains the anistropy of the water quenched specimens, but there is no apparent explanation for the lower anistropy of the air-cooled plate.

The steel products of this invention may therefore be produced in the following manner. A steel melt is adjusted to contain from 2.1 to 6% manganese; carbon should be maintained at a level below about 0.25%, phosphorus below about 0.03%, Ni below 1.5% with silicon up to about 1%. While the instant heat treatment may be employed to enhance notch toughness, even for those steels in which the carbon and phosphorus contents are controlled in accord with prior art practices, the full economic benefits of this invention will be realized by utilizing heats of conventional commercial purity, i.e. in which (a) the carbon content is greater than 0.05%, generally between about 0.1 to 0.2%, (b) Ni is below about 0.5% and (c) the phosphorus content is greater than about 0.008%, generally within the range 0.01 to 0.02%. As noted above, group VB and VIB elements, in the range 0.025 to 1.0%, may be employed to alter annealing response. Of the latter, vanadium within the range 0.02 to 0.08 percent and molybdenum within the range 0.15 to 0.4 percent are preferred. Plate produced from the above melt is then hot rolled, at a temperature above the $A_3$, generally to a thickness of ¼ to 5 inches. The plate is thereafter cooled, e.g. by water quenching or air cooling, at a rate sufficient to transform the austenitic structure to decomposition products consisting substantially of martensite and bainite. Thereafter, the plate is annealed in accord with the teachings of this invention by heating at a temperature within the range $A_s$ to $A_s$ + 75° C for a time sufficient to form at least about 1% by volume of retained austenite at the grain boundaries, but insufficient to form more than a negligible amount of nonretained austenite, i.e. austenite which reverst on cooling. The optimum temperature here is best determined empirically, i.e. to determine an annealing time and temperature, sufficient to provide a CVN increase of at least 20 ft/lbs over that of the same product which had been similarly prepared, but tempered at a temperature just below the $A_s$ (eg. within the range $A_s$ - 25° to $A_s$ - 100° C) of the steel. For steels containing from about 3.5 to 5.0% manganese and less than 0.5% Ni, optimum annealing times will range from about ½ to 8 hours for temperatures within the range of 1160° to 1240° F (627° to 671° C).

We claim:

1. A method for the production of high Mn steels with enhanced notch toughness, which comprises, hot rolling plate consisting essentially of Mn . . . 2.1 to 6%, C . . . 0.25% max., Ni . . . 1.5% max. and Si . . . 1.0% max., said hot-rolling producing a metallurgical structure which is substantially fully austenitic, cooling the plate at a rate sufficient to transform said austenitic structure to austenite decomposition products consisting substantially of martensite, bainite and mixtures thereof, annealing the plate composed of said austenite decomposition products at a temperature within the range $A_s$ to $A_s$ + 75° C for a time sufficient (i) to form at least 1% by volume of retained austenite at the grain boundaries, but insufficient to form more than a negligible amount of non-retained austenite and (ii) to provide a CVN increase, measured at −45.5° C of at least 20 ft-lbs over that of the same plate which has been similarly prepared but tempered at a temperature just below that of the $A_s$ of that steel.

2. The method of claim 1, in which the C content is greater than 0.05%.

3. The method of claim 2, in which the C content is within the range 0.1 to 0.2%.

4. The method of claim 2, in which the P content is greater than 0.008.%

5. The method of claim 4, in which said plate contains a total of from 0.025 to 1.0% of elements selected from groups VB and VIB.

6. The method of claim 5, in which said group VB element is V within the range 0.02 to 0.08% and said group VIB element is Mo within the range 0.15 to 0.4%.

7. The method of claim 2, in which Mn is within the range 3.0 to 5.0%, and said annealing is conducted at a temperature within the range 627° to 671° C.

8. The method of claim 4, in which Mn is within the range 3.0 to 5.0%.

9. The method of claim 8, in which the total amount of retained austenite produced, as a result of said annealing, is less than 10%.

10. Steel plate having a thickness of ¼ to 6 inches and consisting essentially of,

| | |
|---|---|
| Mn | 2.1 to 6.0% |
| C | 0.05 to 0.25% |
| Ni | 0.5% max. |
| P | 0.008 to 0.03% |
| Si | 1.0% max. |

said plate exhibiting a yield strength in excess of 90 ksi and a CVN energy absorption value, measured at −45.5° C, of greater than 30 ft-lbs.

11. The plate of claim 10, having a thickness of ½ to 5 inches and consisting essentially of,

| | |
|---|---|
| Mn | 3.0 to 5.0% |
| C | 0.1 to 0.2% |
| P | 0.01 to 0.02% |

* * * * *

UNITED STATES PATENT OFFICE

CERTIFICATE OF CORRECTION

Patent No. 4,047,979 Dated September 13, 1977

Inventor(s) Raymond A. Grange and Robert L. Miller

It is certified that error appears in the above-identified patent and that said Letters Patent are hereby corrected as shown below:

Column 3, line 25, "plurity" should be -- purity --;

Column 3, line 31, " -20°F " should be -- -50°F --;

Column 3, line 53, "intercritial" should be -- intercritical --;

Column 4, line 34, "thickness" should be -- thicknesses --;

Column 4, line 46, "occured" should be -- occurred --;

Column 4, line 59, "8 hours to" should be -- 8 hours at --;

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*